US007331261B2

(12) United States Patent
Blizniuk et al.

(10) Patent No.: US 7,331,261 B2
(45) Date of Patent: Feb. 19, 2008

(54) CROSSWISE WRENCH

(76) Inventors: Alexandr Alexandrovich Blizniuk, 36 ul. Sovietskoi Armii, Samara (RU); Andrey Borisovich Dobrynin, 77/2 Leningradskiy Prospect, apt. 13, Moscow (RU)

( * ) Notice: Subject to any disclaimer, the term of this patent is extended or adjusted under 35 U.S.C. 154(b) by 0 days.

(21) Appl. No.: 11/515,431

(22) Filed: Sep. 1, 2006

(65) Prior Publication Data

US 2007/0137443 A1 Jun. 21, 2007

(30) Foreign Application Priority Data

Dec. 15, 2005 (RU) ..... 2005139162

(51) Int. Cl.
*B24B 13/00* (2006.01)
*B25B 23/16* (2006.01)

(52) U.S. Cl. ..... 81/124.4; 81/177.2; 81/124.7; 81/125.1; 81/177.5

(58) Field of Classification Search ..... 81/124.4, 81/124.5, 124.7, 125.1, 177.1, 177.2, 177.5
See application file for complete search history.

(56) References Cited

U.S. PATENT DOCUMENTS

| | | | | |
|---|---|---|---|---|
| 3,416,395 | A * | 12/1968 | Hanson | 81/177.5 |
| 5,272,942 | A * | 12/1993 | Hull et al. | 81/124.4 |
| 6,260,452 | B1 * | 7/2001 | Yu | 81/177.2 |
| 7,228,766 | B1 * | 6/2007 | Shyu | 81/177.1 |
| 2004/0099102 | A1 * | 5/2004 | Vaughan | 81/124.4 |
| 2005/0252348 | A1 * | 11/2005 | Ting | 81/177.5 |

* cited by examiner

*Primary Examiner*—Hadi Shakeri
(74) *Attorney, Agent, or Firm*—Merchant & Gould P.C.

(57) ABSTRACT

A crosswise wrench includes a prismatic core with a polygonal cross-section, a face plate nut head on one end and a working point on the other end. The wrench also includes three circular grooves and an extended element having face plate nut heads on its ends. The extended element has at least three identical pairs of apertures with mutually perpendicular axes crossing a longitudinal axis of the extended element at a right angle.

6 Claims, 2 Drawing Sheets

CROSSWISE WRENCH

The present invention relates to mechanical engineering, in particular to the manual tools used for assembling and disassembling threaded fastening elements, mainly in vehicle running gear.

BACKGROUND OF THE INVENTION

Known in the art is a crosswise wrench, containing two pairs of coaxially located cores, which first ends are rigidly connected to each other and on the second end face plates executed as integral parts thereof are nut heads of corresponding size, wherein the axis of the first pair cores is located perpendicular to the axis of the second pair cores (U.S. Pat. No. 2,644,359, 1948).

However the crosswise wrench known in the art has rather low performance parameters as changing the torque strength at screwing up, unscrewing of a threaded fastening element, is carried out only due to change of effort applied by the user, besides the known crosswise wrench is not demountable and therefore takes up a lot of storage space.

The closest prior art crosswise wrench comprises the first core of square section with a face nut head on each of the ends and three fixing recesses (indents), located on its edges and in the middle accordingly. The second core of square section with a face nut head on one end and a working point on the other, and as with three indents located on core edges and in its middle accordingly, the coupling sleeve with a double-sided ball clamp interacting with core indents, with the first square through aperture wherein located is the first core with a possibility of longitudinal movement and fixing in the positions corresponding to the indents thereof, with the second square through aperture wherein located is the second core with a possibility of longitudinal movement and fixing in the positions corresponding to the indents thereof, wherein the axes of square apertures in the sleeve are located in parallel planes and mutually orthogonal, and the double-sided ball clamp is located in the cylindrical aperture made in the coupling sleeve between its square through apertures and which axis is perpendicular to the axes of the said apertures. (DE-A1—No 19715081, 1998).

Good performance of the closest prior art is determined by mounting the cores on the coupling sleeve with the possibility of longitudinal movement in relation thereto and fixing in one of extreme, or in the middle position by means of a ball clamp, which enables changing the arm of force length during screwing up or unscrewing the threaded fastening elements. In other words, the known crosswise wrench allows changing the torque strength by means of both muscular effort applied by the user and changing the arm of force length. Besides the known crosswise wrench can be easily assembled and disassembled and does not take up a lot of storage space when disassembled.

The drawback of the prior art is that it does not provide high reliability of work of a crosswise wrench during its long operation, because the period of reliable work of a known crosswise wrench is determined by the average life of the spring of the double-sided ball clamp, which is difficult to replace due to the position thereof. Besides position of the double sided ball clamp in an aperture located between apertures of the coupling sleeve of square section, makes manufacture of the crosswise wrench more labor intensive, and consequently more costly.

SUMMARY OF THE INVENTION

The present invention seeks to resolve the technical problem of durability of a crosswise wrench by way of increasing reliability of operation and maintainability of the units thereof, ensuring fixing of elements of a crosswise wrench in relation to each other, together with reducing labor intensiveness of the manufacture thereof.

The given task is resolved as follows: a crosswise wrench comprised of an extended element having face plate nut heads on the ends thereof, a prismatic core with a polygonal cross-section, a face plate nut head on the one end and a working point on other end, at least three fixing recesses, one of which is located in the middle of the core, and the two other fixing recesses located at an equal distance in relation to the first fixing recess, in accordance with the invention, the fixing recesses are executed as circular grooves, the extended element has at least three identical pairs of partially mutually transversal apertures with mutually perpendicular axes, which cross the longitudinal axis of the extended element at a right angle, the first apertures of each pair of the partially mutually transversal apertures are through and have the same polygonal shaped cross-section, as the prismatic core and the sizes ensuring its sequential placement in said apertures with the possibility of longitudinal movement, one first aperture located in the middle of the extended element, and the other two first apertures located at an equal distance in relation thereto, wherein the lateral surface edge of the first aperture, crossed by the corresponding second aperture in each pair of the partially mutually transversal apertures is located in diametrical plane of the extended element, perpendicular to axes of the above-mentioned second apertures, each of said apertures provided with a self-resetting push-button clamp, so that each self-resetting push-button clamp has a core with a circular cavity, placed in the second aperture corresponding thereto with enabling back-and-forth axial motion and fixing in the position corresponding to working position of the self-resetting push-button clamp, with one core end spring-backed in relation to the base of the second aperture corresponding thereto, and other core end is provided with a pusher protruding from the extended element in the working position of the self-resetting push-button clamp, radius $R_k$ corresponding to the base of circular grooves, executed in the prism core and the distance—H between axes of the first and second apertures in each pair of the partially of partially mutually transversal apertures obeys the ratio:

$$R_k+R_1 \leqq H < R_{op}+R_1,$$

where:

$R_1$—Radius of the second apertures [M]

$R_{op}$—Radius of a circle circumscribing the polygon of cross-section of the first aperture or the prismatic core [M]

and $R_{pr}$—Radius of circular cavity and its width—h obey the ratio:

$$R_{op}+R_{pr} \leqq H,\ h \geqq 2(R_{op}-R_k)*tg[\pi(n-2)/2n]$$

where:

n—number of sides of a regular polygon of the first aperture cross-section.

Advantage of the proposed crosswise wrench over the closest prior art lies in execution of one of the cores of the crosswise wrench as an extended element, with at least three identical pairs of partially mutually transversal apertures, one of which intended for placing therein of a corresponding self-resetting push-button clamp of the proposed design which ensures not only higher reliability of work at its long operation as compared to the double-sided ball clamp of the closest prior art, but also contributes to better maintainability of the fixing units. Furthermore the proposed crosswise wrench does not have elements which hard-to-access location makes manufacturing and repair more labor intensive. The proposed position if the edge of a lateral surface of each first aperture crossed by the second aperture corresponding thereto in each pair of partially mutually transversal apertures (namely: the edge of a lateral surface of each first aperture, crossed by a second aperture corresponding thereto, is located in a diametrical plane of the extended element, perpendicular to axes of the second apertures, each provided with self-resetting push-button clamp) ensures a wide range (with the zero lower boundary) of width choice of circular groove, executed on the core of each self-resetting push-button clamp and consequently enables reducing its axial size in comparison with any other arrangement of edges of lateral surfaces of the first apertures. Furthermore since prior art does not disclose the use of any self-resetting push-button clamps in wrenches with adjustable torque arm length, it is possible to conclude that the present invention meets the "novelty" and "the inventive step" patentability criteria.

Concrete example of invention embodiment is provided below, however, is not the only possible embodiment, but it clearly demonstrates the possibility to achieve the claimed technical effect by means of the aforesaid set of essential features.

BRIEF DESCRIPTION OF THE DRAWINGS

On FIG. 1 shown is the crosswise wrench, top view.

DETAILED DESCRIPTION OF THE PREFERRED EMBODIMENT(S)

Figure 3:
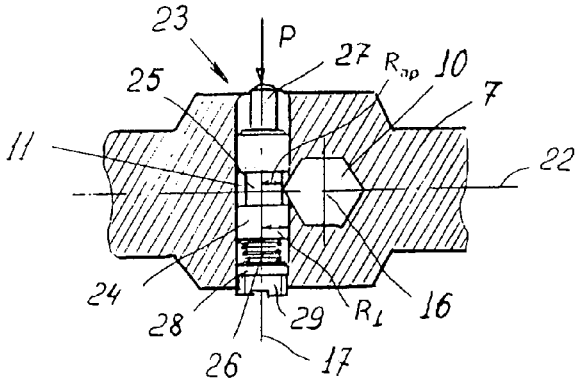
FIG. 3—a self-resetting push-button clamp in non-working position.

The crosswise wrench comprises a prismatic core 1 in with cross-section shaped as a primarily regular polygon (triangle, square, etc., preferably a hexagon), and having a face nut head 2 on one end, a working point 3 with a ball clamp on other end and, at least, with three fixing recesses executed in the form of circular grooves 4, 5, 6. The circular groove 4 is located in the middle part of the prismatic core 1, and the two other circular grooves 5, 6 are located at an equal distance in relation to the circular grooves 4, for example on end parts of the prismatic core 1. The crosswise wrench also contains an extended element 7, with at least one executed as integral parts thereof face nut heads 8, 9 on the ends, and with at least three identical pairs of the partially mutually transversal apertures 10, 11, 12, 13, 14, 15 with mutually perpendicular axes, accordingly 16, 17, 18, 19, 20, 21 which cross the longitudinal axis 22 of the extended element 7 at a right angle. The first aperture of each pair of the partially mutually transversal apertures, namely 10, 12, 14 is executed through with the polygonal cross-section, identical to the cross-section of the prismatic core 1 and sized to ensure sequential placement in apertures 10, 12, 14 of the prismatic core 1 enabling its longitudinal movement, for example with sliding adjustment. The aperture 10 is located in the middle of the extended element 7, and other two apertures 12, 14, located at an equal distance in relation to the aperture 10, for example on end parts of the extended element 1, in such a way, that the edge of a lateral surface of each first aperture 10,12,14, crossed by a corresponding thereto second aperture 11,13,15 is located in a diametrical plane of the extended element 7, perpendicular to axes of 17,19,21 and second apertures 11,13,15, in each provided with a self-resetting push-button clamp 23. Each self-resetting push-button clamp 23 comprises a core 24 with the circular cavity 25, located in the corresponding thereto second aperture 11 (13 and 15)—enabling back and forth axial movement of fixing (due, for instance, to curling of edges of the second apertures) in the position corresponding to the working position of the self-resetting push-button clamp 23, wherein one end of the core 24 spring-backed in relation to the base of the corresponding thereto second aperture 11 (13, 15) by means of the opposing spring 26; on the other end of the core 24 executed is a pusher 27 protruding from the extended element 7 in the working position of the self-resetting push-button clamp 23. In a preferred invention embodiment the base of each second aperture 11,13,15 is executed as a disk 28 with the possibility of its axial moving by means of a screw 29 (FIG. 3).

In the preferred embodiment circular grooves 4/6 have the cross-section in the form of a circle segment with the radius equal to radius $R_1$ of the second apertures 11, 13, 15, the radius $R_k$ corresponding to the base of circular grooves 4/6, and distance H between axes 16 and 17,18 and 19,20 and 21 of apertures 10 and 11, 12 and 13, 14, 15 obey the ratio $$R_k+R_1 \leqq H < R_{op}+R_1$$

where $R_{op}$—radius of the circle circumscribing a polygon of cross-section of the first apertures 10,12 and 14 or a polygon of cross-section of the prismatic core 1. Here it is necessary to note, that the circular grooves 4/6 can be executed with a different cross-section shape, namely: rectangular, trapezoid, etc. The Radius of a circular cavity 25—$R_{pr}$ and its width h obeys the ratio:

$$R_{op}+R_{pr} \leqq H;$$

$$h \geqq 2(R_{op}-R_k)*tg(\alpha/2)$$

where (α)—an internal angle of a polygon of cross-section of apertures 10,12 and 14 which top lays on the edge of a lateral surface of said apertures and which is crossed by a corresponding second aperture. In case of regular polygons $\alpha/2=\pi(n-2)/2n$, where n—number of polygon sides. The extended element 7 is executed, in the preferred embodiment, stepwise longitudinal direction, in other words having nodes at the places of location of each pair of partially mutually traversed apertures. In the preferred embodiment the number of pairs of partially mutually traversed apertures equals either three or five.

Figure 1:
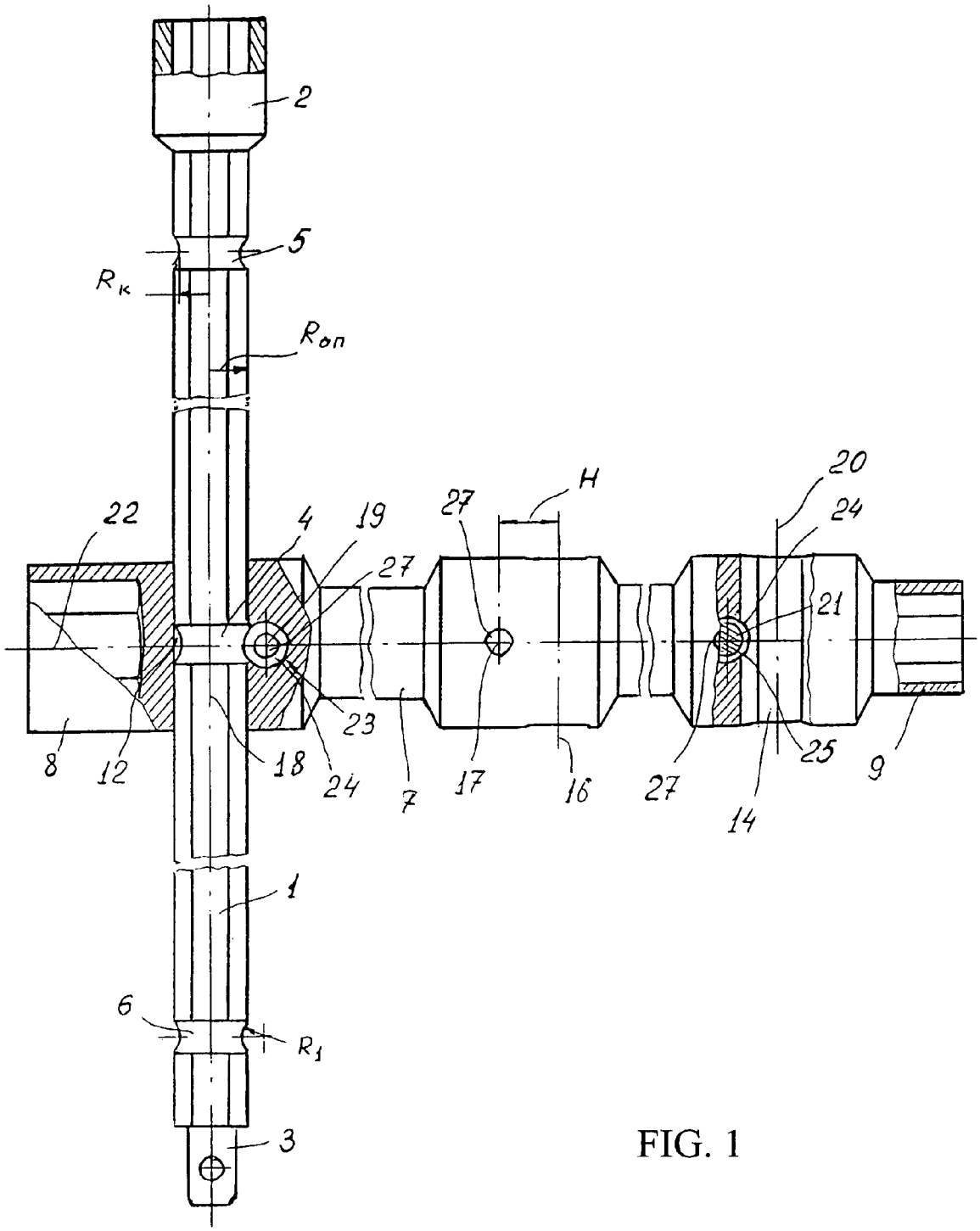
Figure 2:
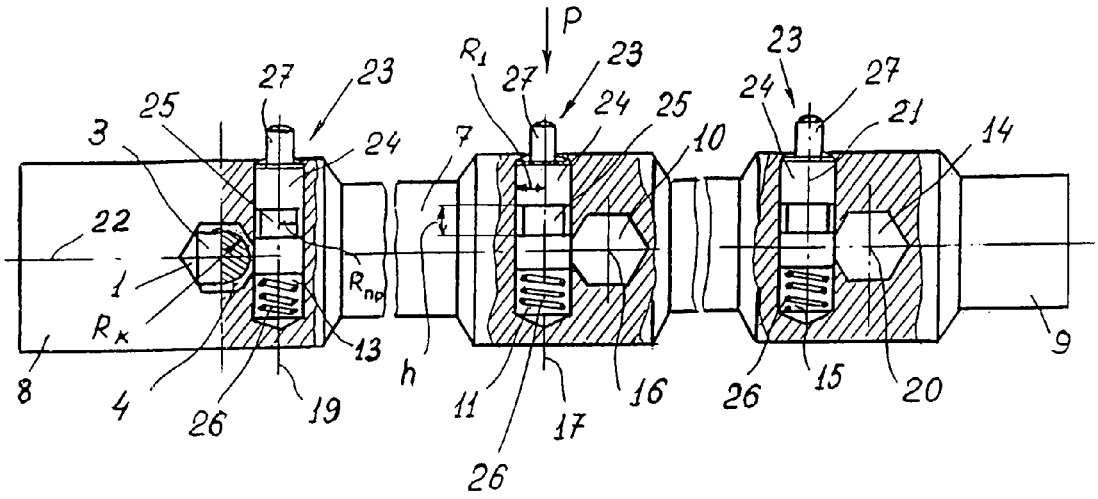
FIG. 2—the crosswise wrench, side view, partial sectional view.

The crosswise wrench is used as follows. As usual, before assembling or disassembling a threaded connection the necessary for the operation size of face nut head is defined. Following which the crosswise wrench is assembled, and if among face nut heads 8 and 9, 7 executed as integral part of the extended element 7, there is a face nut head of the necessary size then, depending on accessibility of the threaded connection and convenience assembling or disassembling the prismatic core 1 is inserted into one of the apertures 10, 12, 14 executed in the extended element 7, for example, in aperture 12 (FIG. 1). For this purpose the user presses the pusher 27 located next to the selected first aperture 12 which in the working position of a corresponding thereto self-resetting push-button clamp 23 protrudes from the extended element 7 (FIG. 2). Here it is necessary to note, that in the working position (FIG. 2) of each self-resetting push-button clamp 23 core 24 partially closes the corresponding thereto first aperture (10, 12, 14). As a result of pressing (applying effort P) the pusher 27, the core 24 moves in an axial direction, resulting in, firstly, compression of the opposing spring 26, and, secondly, full opening of the first aperture due to the fact that the size of the circular cavity 25 of the core 24 obeys the ratio $R_k+R_1 \leqq H$ (FIG. 3).

After the selected self-resetting push-button clamp 23 (as described above) is put in non-working position, the end prismatic core 1 on which the working point 3 is located, is inserted into the selected second aperture 12 executed in the extended element 7 and moved in longitudinal direction until overlapping of the circular groove 4 executed on the prismatic core 1 with the self-resetting push-button clamp 23, which the user already put in non-working position. Then the effort P, applied to the pusher 27 is removed. As a result, the core 24 due to action of the opposing spring 26 moves in axial direction to the starting position, and at the same time partially closing the first aperture 12 in the extended element 7 the core 24 partially enters the circular groove 4. The ensures a more reliable fixing (as compared to the ball clamps known in the art) of the core 1 in relation to the extended element 7 by means of the core 24 located in the aperture 13 and partially in the circular groove 4.

Further, while assembling the threaded connection, the face nut head of the extended element 7 is put on a nut or bolt head of corresponding size and then, while holding the extended element 7 with one hand and with the other hand applying to the core 1 end the effort, necessary for torque strength in clockwise direction, the threaded fastening element is screwed up. When maximum possible torque at the given arm length is reached the self-resetting push-button clamp 23 is again put in non-working position by pressing the corresponding thereto pusher 27. Upon unlocking the prismatic core 1 is moved in longitudinal direction until the circular groove 5 executed in the prismatic core 1 overlaps with the self-resetting push-button clamp 23 put in non-working position. Then the effort P applied to the pusher 27 is removed leading to reliable fixing of the prismatic core 1 in relation to the extended element 7, since due to the action of the opposing spring 26, the core 24 enters into the circular groove 5 section facing the said core (similarly to the above). After that the threaded element is additionally tightened, owing to increase of the torque arm by a factor of two.

When the threaded connection is disassembled the prismatic core 1 is first fixed in the position where the circular groove 6 executed in the core overlaps with the self-resetting push-button clamp 23. In other words, unscrewing the threaded fastening element starts with applying maximum torque strength in counter-clockwise direction. Further, if necessary, the torque arm length may be reduced by means of moving prismatic core 1 in a position, where the circular groove 4 executed in the core 1 overlaps with the self-resetting push-button clamp 23.

If the face nut head of the required size is located on prismatic core 1 or is among replaceable face nut heads, prismatic core 1 is inserted (to similarly the above) in an aperture 10 executed in an extended element 7, in the case when screwing up or unscrewing the threaded fastening element does not require high torque strength. However when screwing up or unscrewing the threaded fastening element it is necessary to ensure high torque strength, the prismatic core 1 is inserted into one of extreme apertures 12 or 14 depending on first, whether the face nut head 2 or replaceable face nut head is used and secondly, the threaded fastening element is screwed up or unscrewed. The screwing up or unscrewing in this case is carried out similarly to the described above process.

To ensure setting the necessary elasticity of the opposing springs 26 the base of the second apertures 11, 13 and 15 is movable (FIG. 3). The opposing springs 26 elasticity is altered by screwing into or screwing out of screw 29 as required, which results in an increase or reduction of elasticity parameters of the opposing springs 26.

The proposed crosswise wrench can be used in various industry sectors, in particular, in motor-car manufacturing and motor car servicing.

The invention claimed is:

1. A crosswise wrench comprising:

an extended element defining a longitudinal axis and having first and second ends with heads on the first and second ends;

a prismatic core with a polygonal cross-section with a face plate nut head on one end of the core and a working point on another end of the core, the core including at least three fixing recesses, including a first fixing recess located in the middle of the core, and the two other fixing recesses located at an equal distance in relation to the first recess, wherein the fixing recesses are circular grooves, the extended element has at least three identical pairs of partially mutually transverse apertures with mutually perpendicular axes, that cross the longitudinal axis of the extended element at a right angle, the first apertures of each pair of the partially mutually transverse apertures are through and have the same polygonal shaped cross-section as the prismatic core and wherein the sizes ensure its sequential placement in said apertures providing for selective longitudinal movement, wherein one first aperture is located in the middle of the extended element and the other two first apertures are located at an equal distance in relation thereto, wherein a lateral surface edge of the first aperture, crossed by the corresponding second aperture in each pair of the partially mutually transverse apertures is located in a diametrical plane of the extended element perpendicular to the axes of the second apertures.

2. A crosswise wrench according to claim 1, wherein each of said transverse apertures is provided with a self-resetting push-button clamp.

3. A crosswise wrench according to claim 2, wherein each self-resetting push-button clamp has a core with a circular cavity, placed in the second aperture corresponding thereto with enabling back-and-forth axial motion and fixing in the position corresponding to working position of the self-resetting push-button clamp.

4. A crosswise wrench according to claim 3, wherein one core end is spring-backed in relation to the base of the second aperture corresponding thereto, and other core end is provided with a pusher protruding from the extended element in the working position of the self-resetting push-button clamp.

5. A crosswise wrench according to claim 1, wherein radius $R_k$ corresponding to the base of circular grooves, executed in the prismatic core and the distance H between axes of the first and second apertures in each pair of the partially mutually transversal apertures are configured so that:

$$R_k+R_1 \leqq H < R_{op}+R_1,$$

wherein:

$R_1$ is a radius of the second apertures, $R_{op}$ is a radius of a circle circumscribing the polygon of cross-section of the first aperture or the prismatic core.

6. A crosswise wrench according to claim 5, wherein:

$R_{pr}$ is a radius of circular cavity and its width—h; wherein the dimensions are configured so that:

$$R_{op}+R_{pr} \leqq H,\ h \geqq 2(R_{op}-R_k)*tg[\pi(n-2)/2n]$$

where:

n—number of sides of a regular polygon of the first aperture cross-section.

* * * * *